US008544368B2

(12) United States Patent
Su

(10) Patent No.: US 8,544,368 B2
(45) Date of Patent: Oct. 1, 2013

(54) MAGNETIC DEVICE ADAPTED FOR BEING ASSEMBLED WITH A SOCKET

(75) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 13/243,238

(22) Filed: Sep. 23, 2011

(65) Prior Publication Data

US 2012/0132039 A1 May 31, 2012

(30) Foreign Application Priority Data

Nov. 30, 2010 (TW) ..... 99141438 A

(51) Int. Cl.
*B25B 13/06* (2006.01)
*B25B 23/12* (2006.01)

(52) U.S. Cl.
USPC ..... 81/125; 81/180.1

(58) Field of Classification Search
USPC ..... 81/125, 180.1; 403/DIG. 1
See application file for complete search history.

(56) References Cited

U.S. PATENT DOCUMENTS

| | | | | | |
|---|---|---|---|---|---|
| 2,806,396 | A | * | 9/1957 | Miller | 81/125 |
| 3,835,737 | A | * | 9/1974 | Carr | 81/125 |
| 4,787,278 | A | * | 11/1988 | Bononi | 81/125 |
| 5,146,814 | A | | 9/1992 | Vasichek | |
| 5,277,088 | A | * | 1/1994 | Vasichek et al. | 81/125 |
| 5,724,872 | A | * | 3/1998 | Shih | 81/125 |

* cited by examiner

*Primary Examiner* — Hadi Shakeri
(74) *Attorney, Agent, or Firm* — Muncy, Geissler, Olds & Lowe, PLLC

(57) ABSTRACT

A magnetic device assembled with a square hole of a socket includes a base received in a connecting portion of the square hole, a magnetic element mounted to an end of the base. The magnetic element magnetically attracts a bolt received in a driving hole of the socket, and at least one expansive portion formed at an end of the base disposed opposite to the magnetic element. The expansive portion selectively hinders a connecting portion of the square hole of the socket. The magnetic device is received in the square hole of the socket without departing from the driving hole of the socket in an operating process.

14 Claims, 12 Drawing Sheets

MAGNETIC DEVICE ADAPTED FOR BEING ASSEMBLED WITH A SOCKET

BACKGROUND OF THE INVENTION

1. Field of the Invention

The present invention relates to a magnetic device adapted for being assembled with a square hole of a socket securely.

2. Description of the Related Art

In an assembling process, a screw is a common tool to be assembled with the mechanical parts. The socket is widely used in the assembling process, because the socket can clamp the six surfaces of the screw at the same time to avoid the surfaces of the screw are damaged. Moreover, the socket can be used with a power tool or an electronic tool to increase the operating efficiency.

In order to clamp the screw by the socket securely in the assembling or the disassembling process, hence the manufacturers fabricate a magnetic accessory in the internal part of the socket. The magnetic accessory attracts the screw in the assembling or the disassembling process to avoid the screw departing from the socket. U.S. Pat. No. 5,146,814 discloses an accessory for a wrench socket which includes a socket, a disk, and a magnet. The socket includes a well having a hexagonal inner periphery to receive the head of a bolt, a burr, or like fastener. The socket includes a handle mounting end including a square opening for receiving a complementary shaped shank of any conventional wrench handle. The disk is glued or otherwise permanently secured to the magnet, and a diameter of the disk is greater than the hexagonal interior periphery. The disk is deformable under a force to pass into and snugly fit within the inner periphery of the well. However, when a user wants to remove the fastener from the socket, the disk is affected by the magnetic force, which pulls toward the outside of the socket from the magnet. Moreover, it relies on a frictional force to couple with the disk and the socket. Thus, while the magnetic socket has used for a period of time, the disk and the magnet are affected by external force to break away from the socket in all probability. As mentioned above, this design makes the magnetic socket is not durable.

Furthermore, the size of the different sockets have the size of the different hexagonal inner periphery, so the disk must be sized according to the size of the different hexagonal inner periphery, namely, one size of the socket only corresponds to one size of the socket. The manufacturers making different sized molds corresponding to every size of the sockets increases manufacturing costs.

In addition, the disk and the magnet are received in the hexagonal inner periphery to occupy the part of the receiving space of the hexagonal inner periphery. It makes the receiving space reduced. Thus, in the assembling process, the fastener may get stripped, because the fastener can not be received in the receiving space completely.

The present invention is, therefore, intended to obviate or at least alleviate the problems encountered in the prior art.

SUMMARY OF THE INVENTION

According to the present invention, a magnetic device being assembled with a square hole of a socket includes a base received in a connecting portion of the square hole, a magnetic element mounted to an end of the base. The magnetic element magnetically attracts a bolt received in a driving hole of the socket. At least one expansive portion is formed at an end of the base and disposed opposite to the magnetic element. The expansive portion is selectively hindering a connecting portion of the square hole of the socket. The magnetic device is received in the square hole of the socket without departing from the driving hole of the socket in an operating process.

It is an object of the present invention to provide the expansive portion having a fitting surface abutting against the limit surface of the restricting portion to avoid the base moving toward the driving portion of the socket.

It is also an object of the present invention to provide a surface of the magnetic element disposed opposite to the magnetic surface not to bulge out the standard surface, therefore the bolt is received in the driving hole without interfering with the magnetic element.

It is yet another object of the present invention to provide that a thickness is less than a longitudinal gap, so the base is not interfered with the driving joint.

It is further another object of the present invention to provide that the base received in the square hole with the close fit avoids the magnetic device departed from the driving hole.

DETAILED DESCRIPTION OF THE PREFERRED EMBODIMENTS

Figure 1:
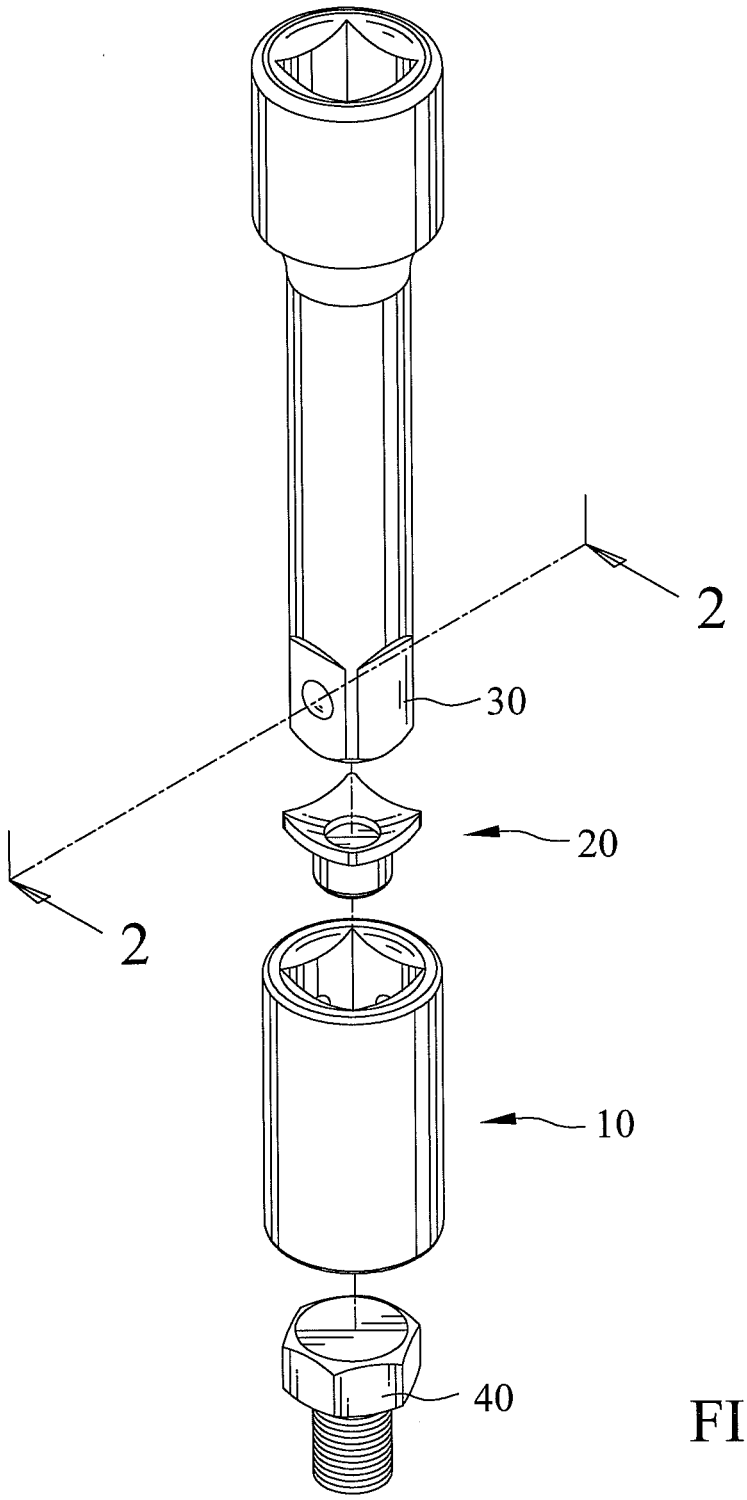
FIG. 1 illustrates how a magnetic device assembled with a socket in accordance with a first embodiment of the present invention.
Figure 2:
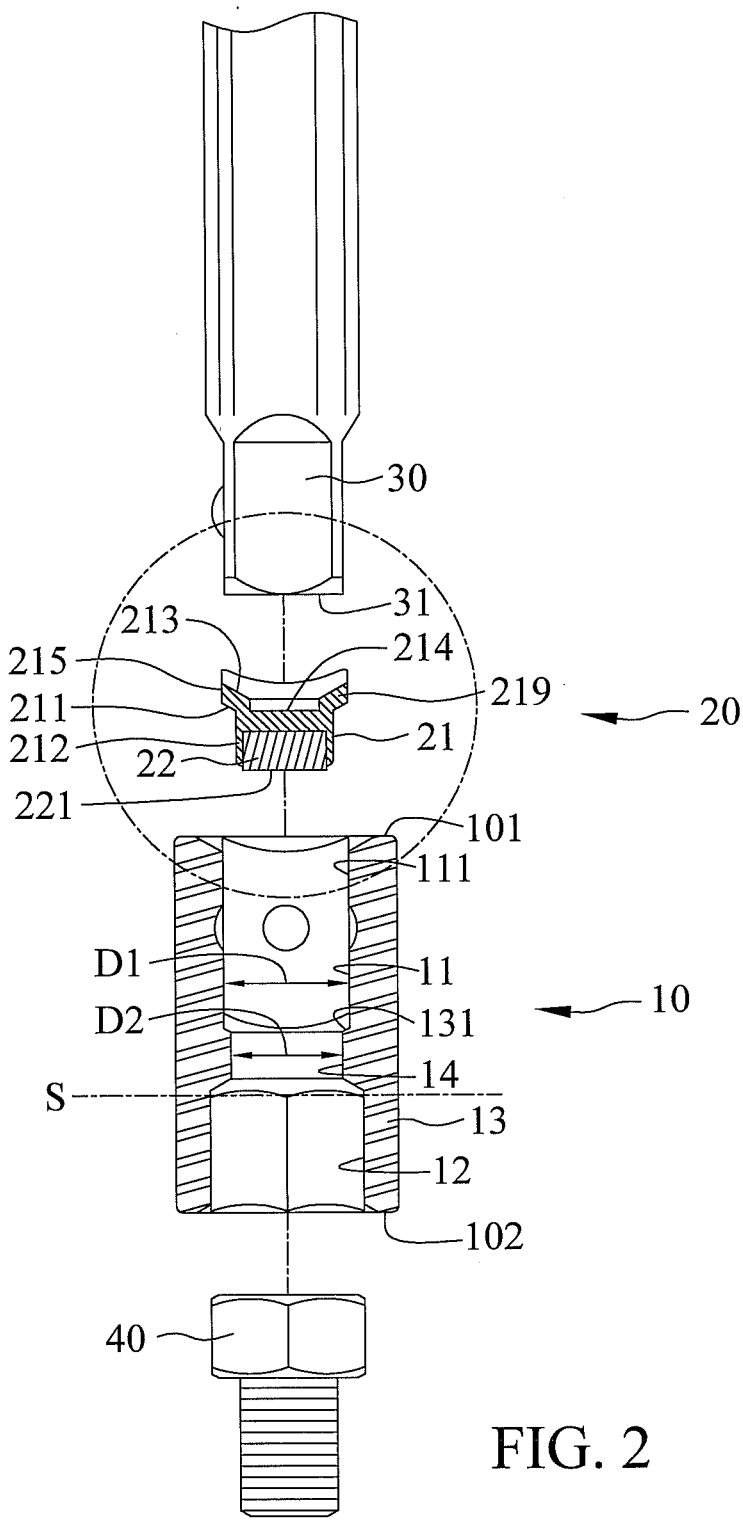
FIG. 2 is a cross-sectional view taken along line 2-2 of FIG. 1.
Figure 3:
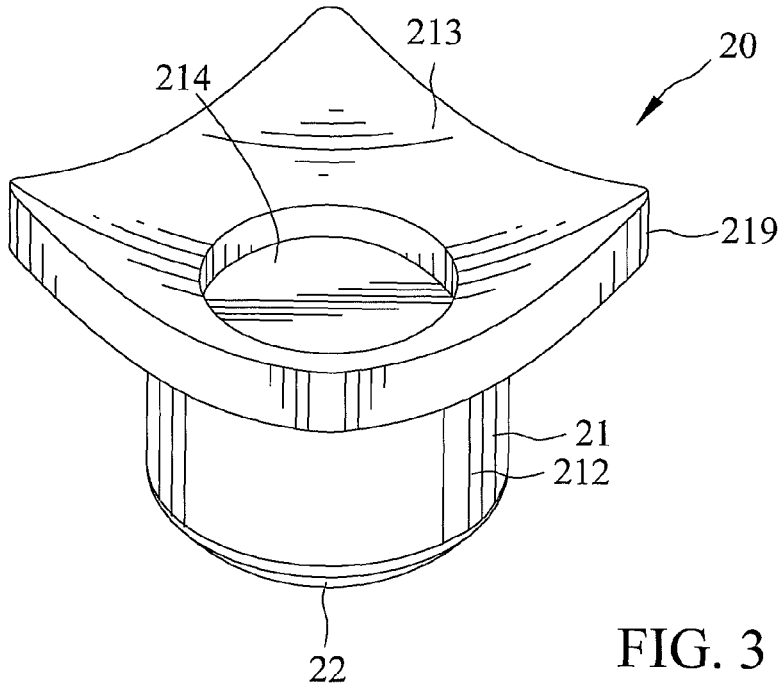
FIG. 3 is a perspective view of a magnetic device in accordance with the first embodiment of the present invention.
Figure 4:
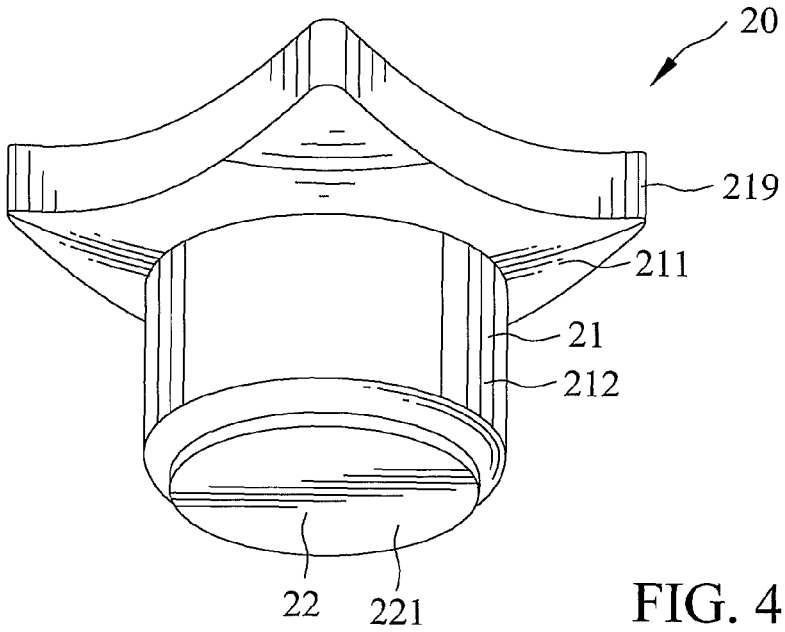
FIG. 4 is a perspective view similar to FIG. 3, except taken from a different angle of view.
Figure 5:
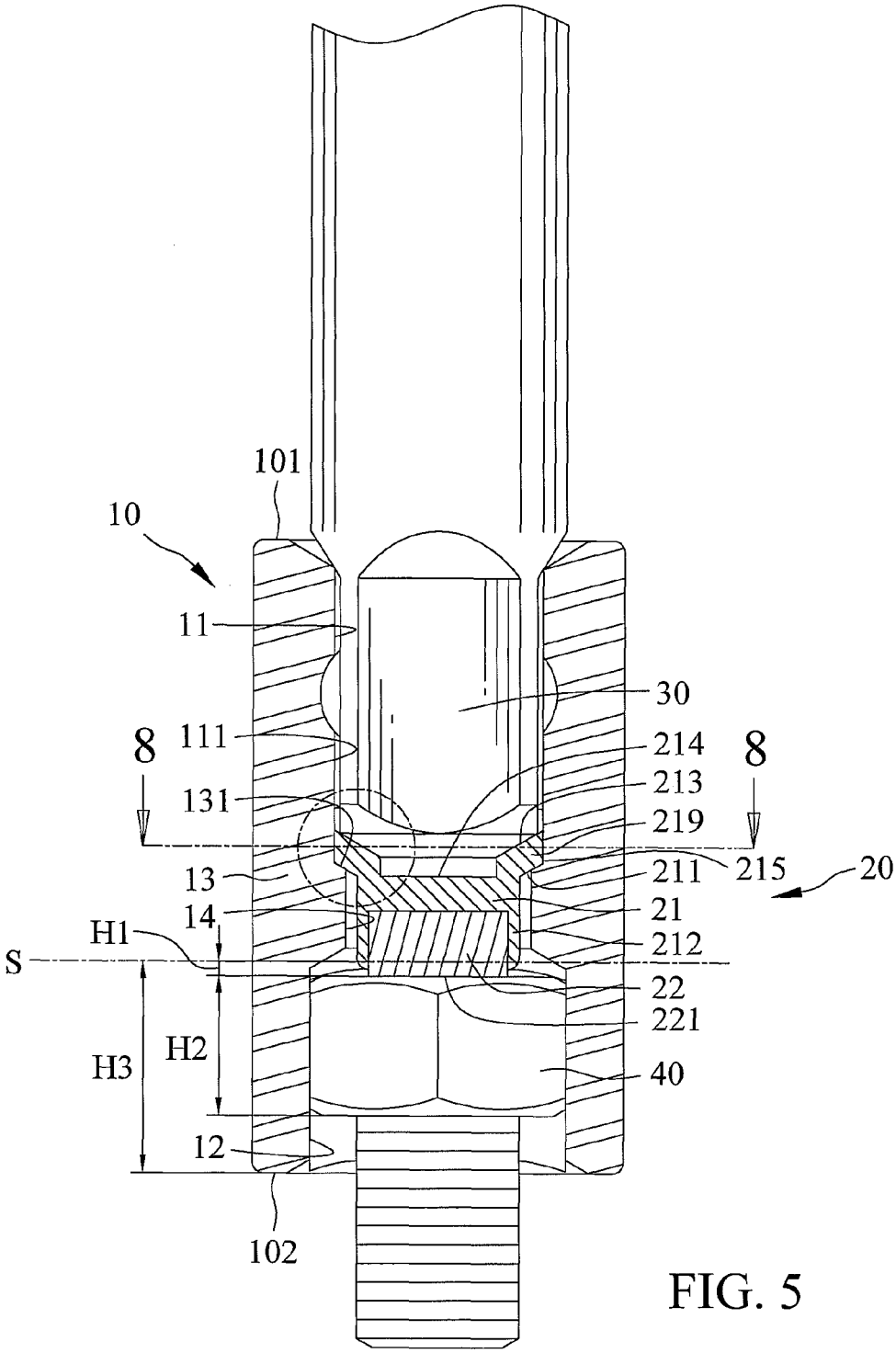
FIG. 5 is a cross-sectional view, with a square hole mounted to a drive joint, with a driving hole receiving a bolt.
Figure 6:
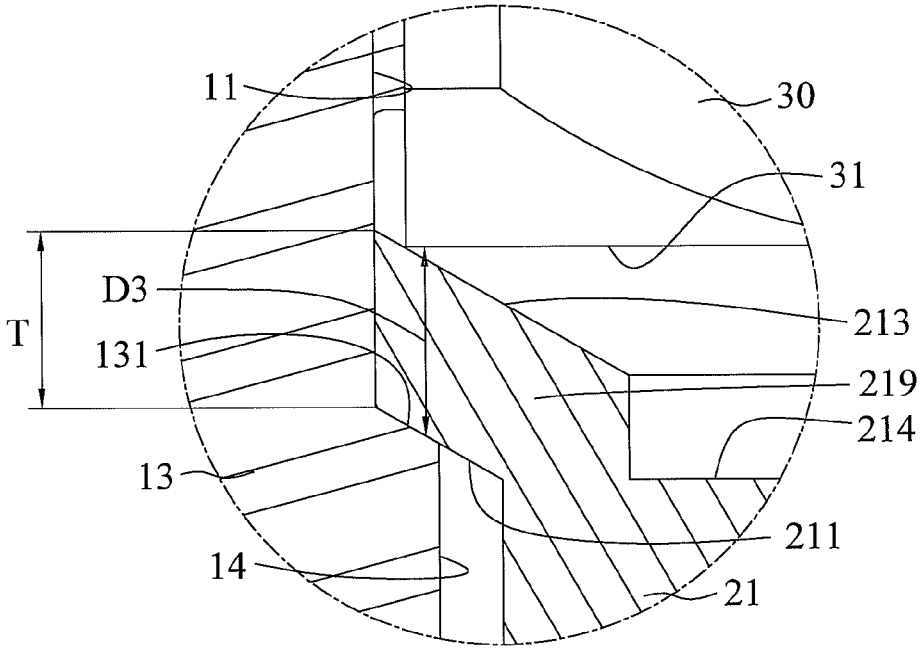
FIG. 6 is a partial, enlarged view of FIG. 5.
Figure 7:
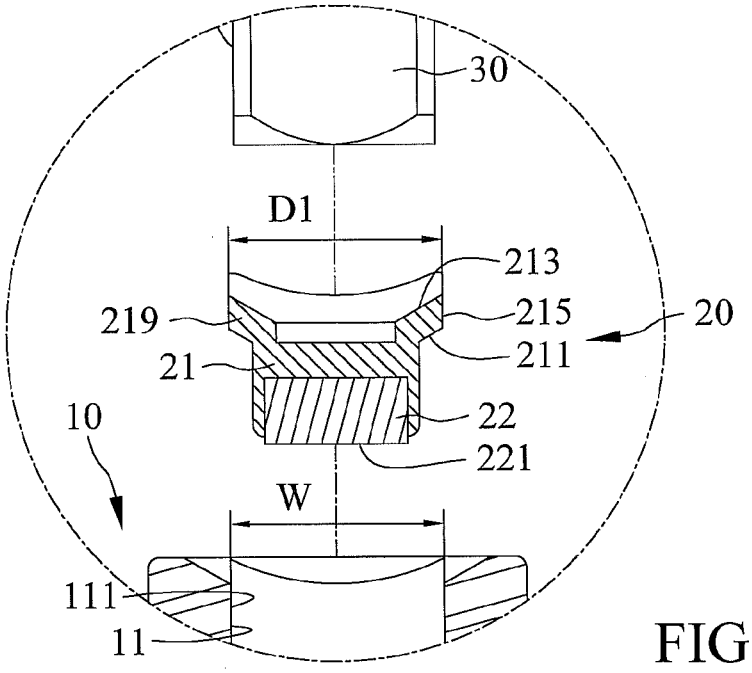
FIG. 7 is a partial, enlarged view of FIG. 2.
Figure 8:
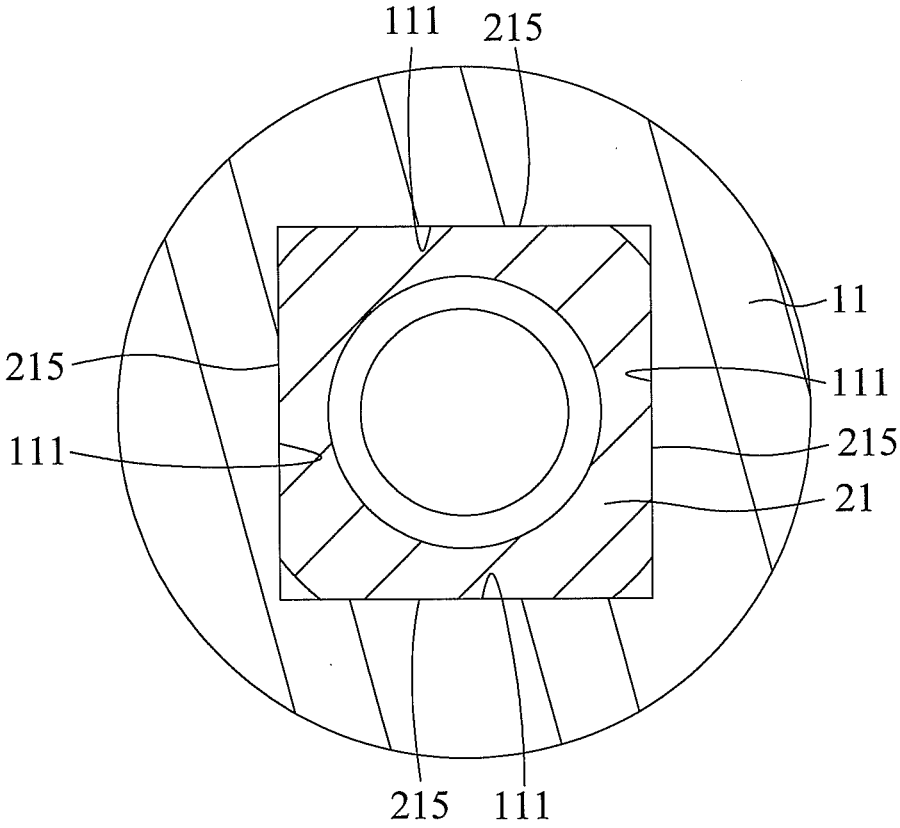
FIG. 8 is a cross-sectional view taken along line 8-8 of FIG. 5.
Figure 9:
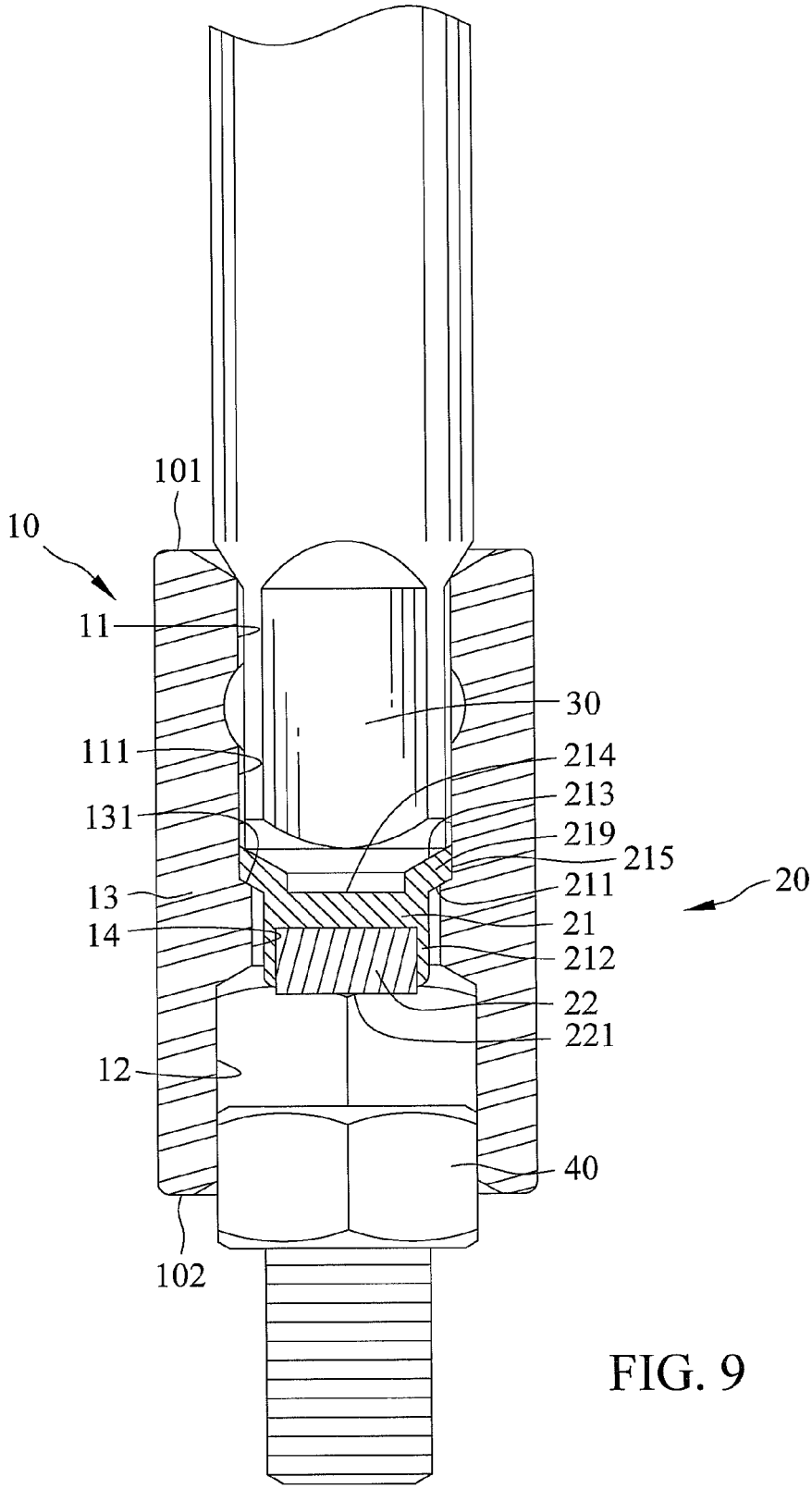
FIG. 9 is a continued cross-section view of FIG. 5 and shows the bolt departed from the driving hole.
Figure 10:
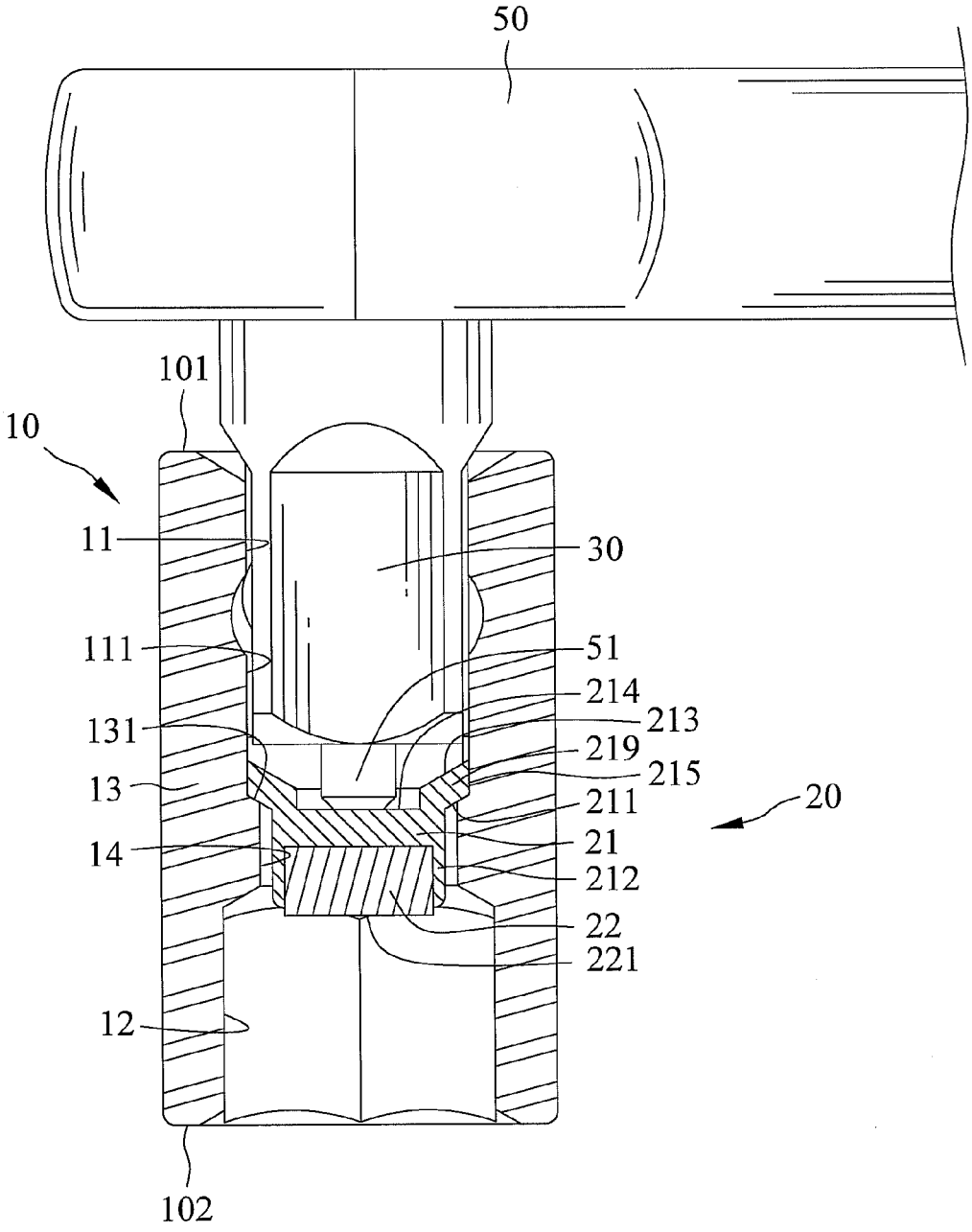
FIG. 10 illustrates when the socket is departed from a ratchet wrench, how a top rod of the ratchet wrench abutting against a slot of a base with the first embodiment of the present invention.

Referring to FIGS. 1 through 10, a magnetic device 20 according to a first embodiment of the present invention includes a base 21 received in a square hole 11 of a socket 10, and a magnetic element 22 mounted to an end of the base 21.

The magnetic device 20 is adapted for being assembled with the square hole 11 of the socket 10. The socket 10 includes a connecting portion 101 connecting a driving joint 30 and a driving portion 102 driving a bolt 40. The connecting portion 101 and the driving portion 102 are formed at two opposite ends of the socket 10. The connecting portion 101 of the socket 10 has the square hole 11 extending along the socket 10 longitudinally. The square hole 11 is adapted for connecting the driving joint 30 being square head type. The square hole 11 of the socket 10 is adapted for connecting to the corresponding sized driving joint 30 of a power tool, an electric tool, or like a manual wrench. The square hole 11 of the socket 10 is defined with a first minimum radial distance D1 in a radial direction of the socket 10.

The driving portion 102 of the socket 10 has a driving hole 12 adapted for received the bolt 40 extending along the socket 10 longitudinally. When the socket 10 is rotated by the driving joint 30, the driving hole 12 activates the bolt 40. Hence the bolt 40 can be fastened or untightened. In the first embodiment of the present invention, the driving hole 12 of the socket 10 is a hexagon hole and is adapted for being used with a hexagon screw.

The socket 10 further includes a restricting portion 13 formed between the connecting portion 101 and the driving portion 102. The square hole 11 and the driving hole 12 in the socket 10 are delimited by the restricting portion 13. The restricting portion 13 of the socket 10 has a through hole 14 connecting to and communicate with the square hole 11 and the driving hole 12. In the first embodiment of the present invention, the through hole 14 of the socket 10 is generally circular hole in shape. The through hole 14 of the socket 10 is defined with a second minimum radial distance D2 in a radial direction of the socket 10. The second minimum radial distance D2 is less than the first minimum radial distance D1. Therefore, the restricting portion 13 has a limit surface 131 formed between the through hole 14 and the square hole 11.

The base 21 includes at least one expansive portion 219 formed at an end of the base 21 disposed opposite to the magnetic element 22. The expansive portion 219 selectively hinders the connecting portion 101 of the square hole 11 of the socket 10 so that the magnetic device 20 is received in the square hole 11 of the socket 10 without departing from the driving hole 12 of the socket 10 in a operating process. In the first embodiment of the present invention, the expansive portion 219 hinders the restricting portion 13. The base 21 includes an expansive portion 219 being square in shape surrounding the base 21. The expansive portion 219 includes four corners abutting against four corners of the square hole 11 of the socket 10.

The expansive portion 219 has a fitting surface 211 abutting against the limit surface 131 of the restricting portion 13. The fitting surface 211 is generally convex in shape. The limit surface 131 connects with the square hole 11 and the through hole 14 to form an angle (not shown) with the through hole 14. The fitting surface 211 of the base 21 selectively abuts against the limit surface 131 of the restricting portion 13 to avoid the base 21 moving toward the socket 10.

The base 21 includes an assembling portion 212 extending toward the driving hole 12. The magnetic element 22 abuts against the bolt 40 directly and magnetically attracts the bolt 40. The magnetic element 22 coupled with the assembling portion 212 magnetically attracts the bolt 40 received in the driving hole 12. A standard surface S is defined in a border disposed between the driving hole 12 and the restricting portion 13. When the bolt 40 is received in the driving hole 12, the bolt 40 moves toward the connecting portion 101 to the standard surface S, hence the bolt 40 impeded by the restricting portion 13 can not move toward the connecting portion 101 continuously.

The expansive portion 219 has an exterior surface 213. In the first embodiment of the present invention, the exterior surface 213 is generally concave in shape and parallel with the fitting surface 211. The base 21 has a thickness T defined between the exterior surface 213 and the fitting surface 211. When the driving joint 30 is received in the square hole 11, a longitudinal gap D3 is defined between a top surface 31 of the driving joint 30 and the limit surface 131 of the restricting portion 13. The top surface 31 of the driving joint 30 selectively abuts against the exterior surface 213. The thickness T is less than the longitudinal gap D3, so the base 21 is not interfered with the driving joint 30. Therefore, when the magnetic device 20 is assembled with the square hole 11 of the socket 10, the driving joint 30 is coupled with the square hole 11 securely.

The base 20 further includes a slot 214 at a center of the exterior surface 213. The slot 214 receives a top rod 51 of a ratchet wrench 50. The magnetic element 22 has a magnetic surface 221, which bulges out the standard surface S. Hence, the magnetic device 20 reaches into the driving hole 12. A first height H1 is defined between the magnetic surface 221 and the standard surface S. A hexagon head of the bolt 40 is defined with a second height H2. A third height H3 is defined between the standard surface S and the driving portion 102 of the socket 10. The first, second, and third heights H1, H2, and H3 are set to satisfy a relation: $H1+H2<H3$.

This means that the first height H1 plus the second height H2 is less than the third height H3, thus the bolt 40 can be received in the driving hole 12. Therefore, a force from the socket 10 can transmit to the bolt 40 completely.

In the first embodiment of the present invention, the base 21 of the magnetic device 20 is received in the square hole 11 of the socket 10 with a close fit. The square hole 11 includes four inner surfaces 111 therein. Between the two inner surfaces 111 disposed opposite to each other, and the four inner surfaces 111 are defined with the first minimum radial distance D1. The expansive portion 219 of the base 21 includes four side surfaces 215 extending from the fitting surface 211 to the exterior surface 213. The side surfaces 215 are opposite to the four inner surfaces 111, respectively. Between the two side surfaces 215 disposed opposite to each other, of the four side surfaces 215 is defined with a width W, which is greater than the first minimum radial distance D1. Thus, the base 21 is received in the square hole 11 with the close fit. It avoids the magnetic device 20 to be departed from the driving hole 12.

When a user makes the bolt 40 detached from the driving hole 12 of the socket 10, the bolt 40 is affected by the magnetic force that is from the magnetic element 22. Hence, the base 21 is moved toward the driving portion 102 of the socket 10 by a pulling force. Because the fitting surface 211 of the base 21 abuts against the limit surface 131 of the restricting portion 13, so the magnetic device 20 is not departed from the driving hole 12. Moreover, a friction force produced between the side surface 215 of the expansive portion 219 of the base 21 and the inner surface 111 of the square 11 by the close fit makes that the magnetic device 20 is not departed from the driving hole 12 of the socket 10 by the pulling force. Therefore, the magnetic device 20 is assembled with the socket 10 securely.

When the user makes the top rod 51 of the ratchet wrench 50 abut against the slot 214 of the base 21 each other, the ratchet wrench 50 is detached from the driving hole 12 of the socket 10. In detaching process, the base 21 abutted against the top rod 51 of the ratchet wrench 50 produces a pushing force toward the driving portion 102 of the socket 10. However, the fitting surface 211 of the expansive portion 219 of the base 21 abuts against the limit surface 131 of the restricting portion 13 of the socket 10, so that the magnetic device 20 is not departed from the driving hole 12. The friction force produced between the side surface 215 of the expansive portion 219 of the base 21 and the inner surface 111 of the square 11 by the close fit makes that the magnetic device 20 is not departed from the driving hole 12 of the socket 10 by the pushing force. In addition, after the ratchet wrench 50 had detached from the socket 10, the magnetic device 20 is still received in the square hole 11 by the friction force produced between the side surface 215 and the inner surface 111. It avoids that the magnetic device 20 is departed from the connecting portion 101 of the socket 10.

Figure 11:
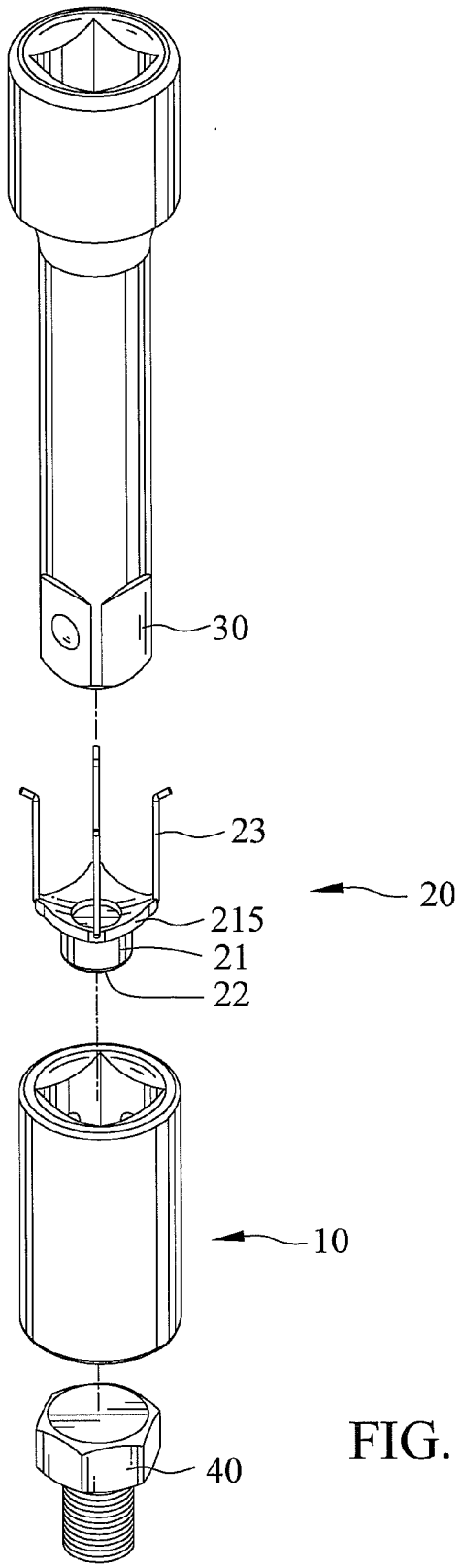
FIG. 11 illustrates how a magnetic device is assembled with a socket in accordance with a second embodiment of the present invention.
Figure 12:
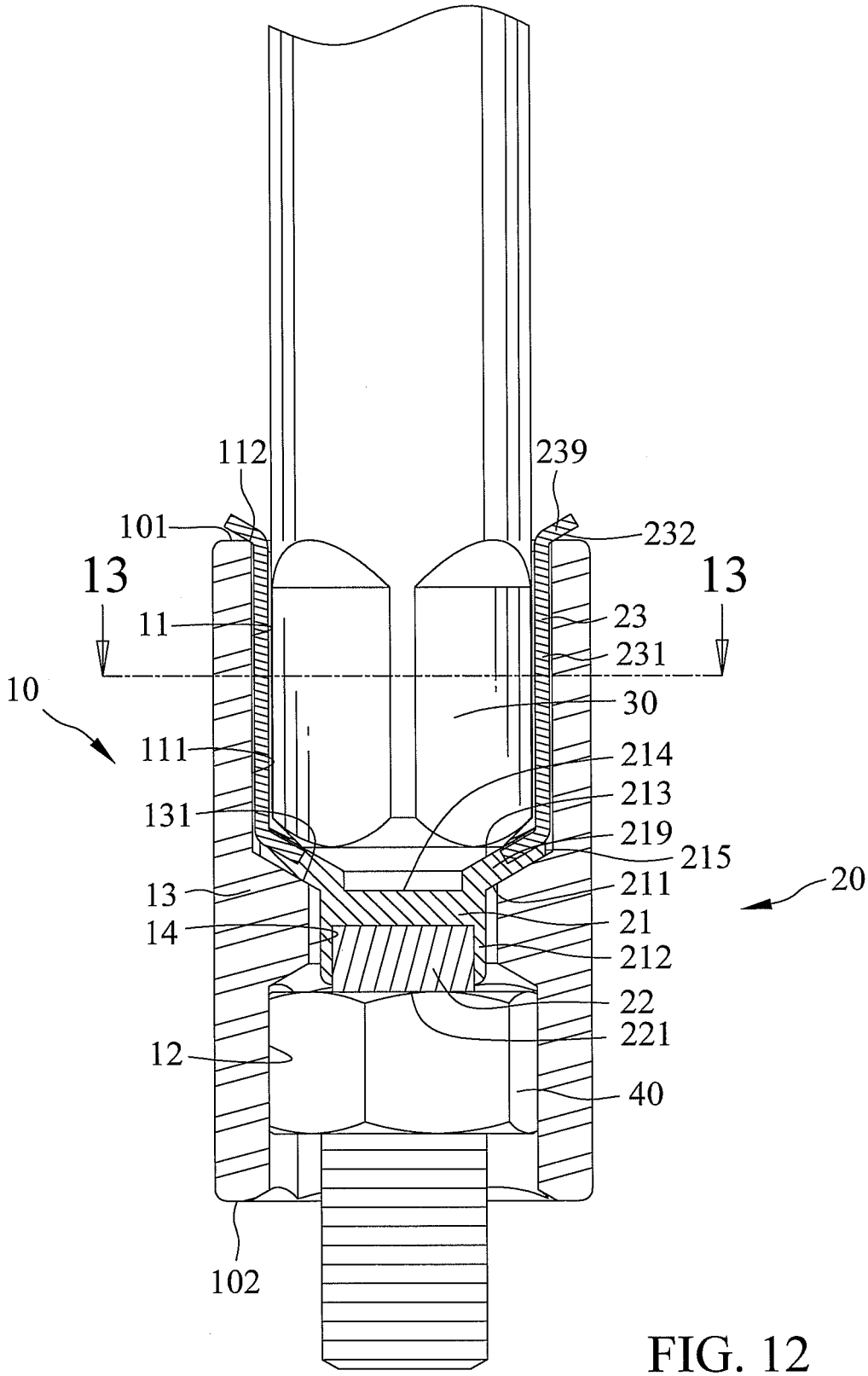
FIG. 12 is a cross-sectional view in accordance with the second embodiment of the present invention.
Figure 13:
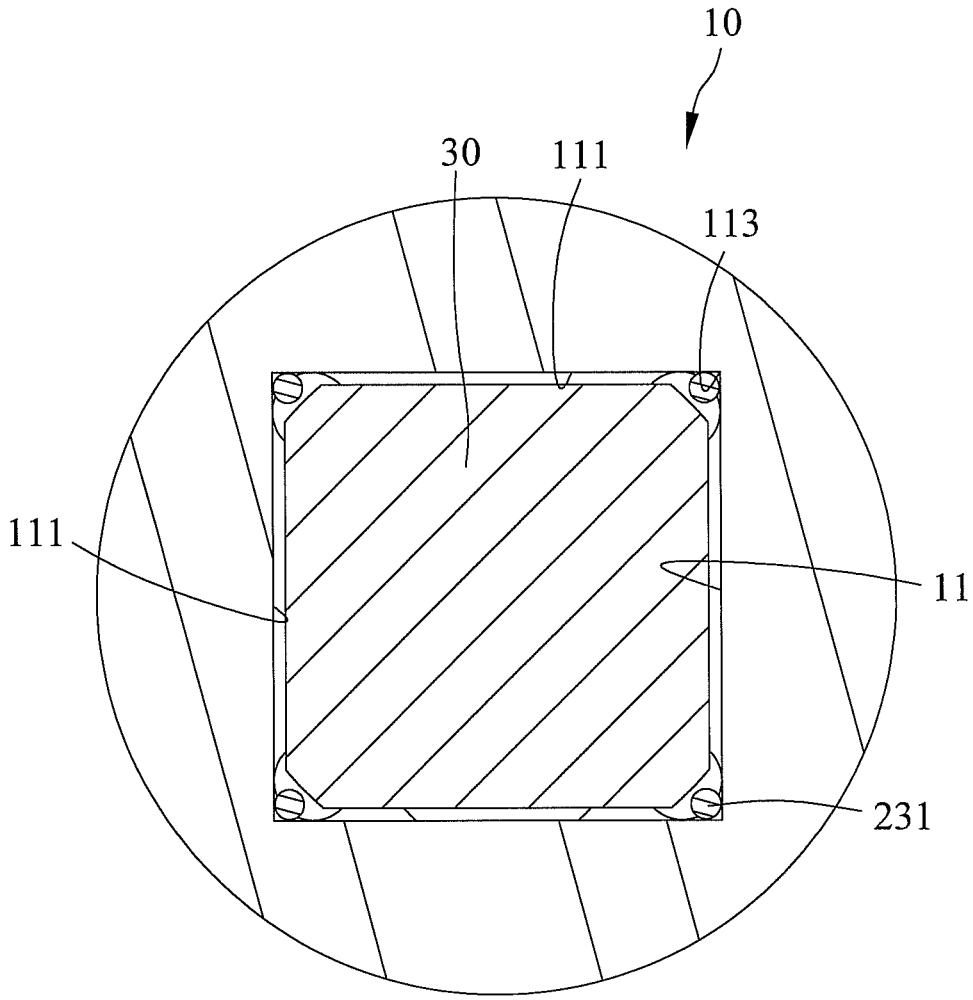
FIG. 13 is a cross-sectional view taken along line 13-13 of FIG. 12.

Referring to FIGS. 11 and 13, a magnetic device 20 according to a second embodiment of the present invention, which is similar to the first embodiment substantially, includes a base 21 received in a square hole 11 of a socket 10, and a magnetic element 22 mounted to an end of the base 21. The base 21 includes at least one expansive portion 239 formed at an end of the base 21 disposed opposite to the magnetic element 22. The expansive portion 239 selectively hinders the connecting portion 101 of the square hole 11 so that the magnetic device 20 is received in the square hole 11 of the socket 10 without departing from the driving hole 12 of the socket 10 in the operating process. The connecting portion 101 of the sock 10 has a buckle surface 112 adjacent to the square hole 11. The buckle surface 112 and the inner surface 111 form an angle therebetween (not numbered).

The difference between the first and second embodiments is that the expansive portion 239 of the base 21 selectively abuts against the buckle surface 112. In the second embodiment of the present invention, the base 21 includes four expansive portions 239, and the expansive portion 239 has an extending arm 231 connecting an end of the base 21. An end of the extending arm 231 connects with the base 21, and the other end of the extending arm 231 connects with the expansive portions 239. The expansive portion 239 has a fitting surface 232 selectively abutting against with respect to the buckle surface 112.

In the second embodiment of the present invention, the extending arm 231 and the expansive portion 239 are formed of a metal wire 23. The extending arm 231, the expansive portion 239, and the base 21 are integrally formed as a single.

The two inner surfaces 111 adjacent to each other form a turning angle 113 therebetween. The extending arm 231 extending to the square hole 11 toward the turning angle 113 makes the fitting surface 232 of the expansive portion 239 abut against the buckle surface 112. When the driving joint 30 is received in the square hole 11 of the socket 10, a gap formed between a bevel of the driving joint 30 and the turning angle 113 receives the extending arm 231, so the extending arm 231 does not interfere with the driving joint 30. The fitting surface 232 abuts against the buckle surface 112 to avoid the base 21 moving toward the driving portion 102 of the socket 10 and to allow the magnetic device 20 to be departed from the driving hole 12.

The base 21 of the magnetic device 20 includes an expansive portion 219 abutting against the restricting portion 13, and four expansive portions 239 abutting against the buckle surface 112.

Figure 14:
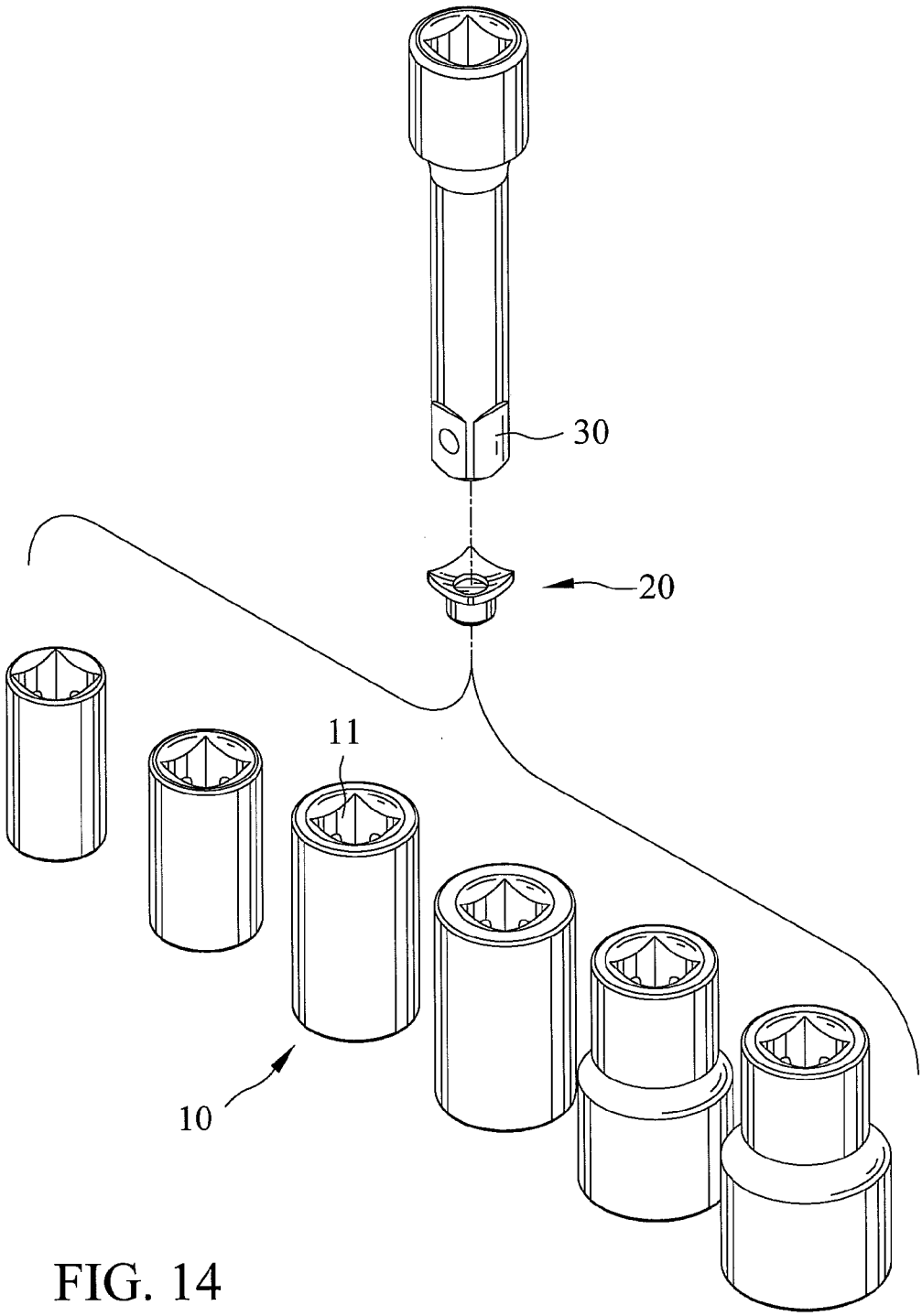
FIG. 14 is a perspective view of a magnetic device and shows the magnetic device usable for the different size driving hole of the socket.

Referring to FIG. 14, the driving hole 12 of socket 10 is sized according to the different requirement. Each different size driving hole 12 of socket 10 can match the one size square hole 11. For this reason, the same size square hole 11 of the socket 10 can match the one size magnetic device 20 promptly. It reduces the manufacturing costs dramatically.

While the specific embodiments have been illustrated and described, numerous modifications come to mind without significantly departing from the spirit of invention, and the scope of invention is only limited by the scope of the accompanying claims.

What is claimed is:

1. A magnetic device adapted to be assembled with a square hole of a socket comprising:

a base received in a connecting portion of the square hole;

a magnetic element mounted to an end of the base, with the magnetic element magnetically attracting a bolt received in a driving hole of the socket disposed opposite to the square hole; and at least one expansive portion formed at an end of the base opposite to the magnetic element, with the expansive portion selectively hindering the connecting portion of the square hole of the socket, wherein the expansive portion includes an extending arm connecting an end of the base, with an end of the extending arm connecting with the base, with the other end of the extending arm connecting with the expansive portions, with the extending arm extending to the square hole toward a turning angle, wherein the magnetic device is received in the square hole of the socket without departing from the driving hole of the socket in an operating process.

2. The magnetic device as claimed in claim 1, wherein the expansive portion hinders a restricting portion formed between the connecting portion and a driving portion of the socket.

3. The magnetic device as claimed in claim 2, wherein the expansive portion has a fitting surface abutting against a limit surface of the restricting portion.

4. The magnetic device as claimed in claim 3, wherein the expansive portion has an exterior surface, with the base having a thickness defined between the exterior surface and the fitting surface, with a longitudinal gap defined between a top surface of a driving joint and the limit surface of the restricting portion, wherein the thickness is less than the longitudinal gap.

5. The magnetic device as claimed in claim 4, wherein the base further includes a slot at a center of the exterior surface, with the slot receiving a top rod of a ratchet wrench.

6. The magnetic device as claimed in claim 4, with the top surface of the driving joint selectively abutting against the exterior surface.

7. The magnetic device as claimed in claim 1, wherein the base includes the at least one expansive portion including one expansive portion, wherein the expansive portion is square in shape surrounding the base.

8. The magnetic device as claimed in claim 7, wherein the expansive portion of the base includes four side surfaces disposed opposite to four inner surfaces of the socket, respectively, wherein the square hole of the socket is defined with a first minimum radial distance between the two inner surfaces disposed opposite to each other, wherein the expansive portion is defined with a width between the two side surfaces disposed opposite to each other, wherein the width is greater than the first minimum radial distance.

9. The magnetic device as claimed in claim 7, wherein the expansive portion includes four corners abutting against four corners of the square hole of the socket, respectively.

10. The magnetic device as claimed in claim 1, wherein the expansive portion includes a fitting surface abutting against a buckle surface of the square hole.

11. The magnetic device as claimed in claim 10, wherein the base includes at least one expansive portions including four expansive portions.

12. The magnetic device as claimed in claim 11, wherein the extending arm and the expansive portion are formed of a metal wire.

13. The magnetic device as claimed in claim 1, wherein the magnetic element includes a magnetic surface bulging out a standard surface defined between the driving hole and a restricting portion, with a first height defined between the magnetic surface and the standard surface, with a hexagon head of the bolt defined with a second height, with a third height defined between the standard surface and a driving portion of the socket, wherein the first height plus the second height is less than the third height.

14. The magnetic device as claimed in claim 1, wherein the magnetic element abuts against the bolt directly and magnetically attracts the bolt.

* * * * *